US007279627B2

(12) United States Patent
Tanaka

(10) Patent No.: US 7,279,627 B2
(45) Date of Patent: Oct. 9, 2007

(54) ACTION FOR PIANO

(75) Inventor: Kousuke Tanaka, Shizuoka-ken (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 41 days.

(21) Appl. No.: 11/372,596

(22) Filed: Mar. 10, 2006

(65) Prior Publication Data

US 2006/0201308 A1 Sep. 14, 2006

(30) Foreign Application Priority Data

Mar. 11, 2005 (JP) ..... 2005-069687
Jul. 14, 2005 (JP) ..... 2005-205933

(51) Int. Cl.
*G10G 3/00* (2006.01)

(52) U.S. Cl. ..... 84/453

(58) Field of Classification Search ..... 84/236–255
See application file for complete search history.

(56) References Cited

U.S. PATENT DOCUMENTS 1,351,512 A 8/1920 Goble
2,542,306 A 2/1951 Brown
2,571,298 A * 10/1951 Thurston et al. ..... 84/240
3,583,271 A 6/1971 Corwin et al.
4,685,371 A * 8/1987 Levinson ..... 84/239
4,953,433 A * 9/1990 Fandrich et al. ..... 84/239
5,272,950 A 12/1993 Petersen
2002/0189422 A1 12/2002 Yoshisue et al.

FOREIGN PATENT DOCUMENTS

GB 174390 A 1/1922
GB 816350 A 7/1959
GB 2 256 522 A 12/1992
JP 06-083326 3/1994

* cited by examiner

*Primary Examiner*—Kimberly Lockett
(74) *Attorney, Agent, or Firm*—Crowell & Moring LLP

(57) ABSTRACT

An action for a piano is provided for clarifying a timing of let-off, improving the sequential touching capabilities, and consequently realizing high playing performance excellent in expressive power in a simple structure without adversely affecting the key touch feeling. The action for a piano swings a hammer in response to a touch on a key, and comprises a wippen pushed up by the key to pivotally move, a regulating button having a flat jack contact surface on the lower end, and a jack having a flat regulating button contact surface which comes into contact with the jack contact surface as the key is depressed. The jack comprises a molding made of a thermoplastic resin containing long fibers for reinforcement.

7 Claims, 8 Drawing Sheets

ACTION FOR PIANO

BACKGROUND OF THE INVENTION

1. Field of the Invention

The present invention relates to an action for a piano which actuates in response to a depression on an associated key to swing a hammer which in turn strikes a string.

2. Description of the Prior Art

A known conventional action for a piano is disclosed, for example, in Laid-open Japanese Patent Application No. 6-83326. FIG. 1 illustrates main components of an action 51 in a key released state. The action 51 is adapted for an upright piano, and is disposed above the rear end of a key 50 (the left-hand side in FIG. 1 is assumed to be the rear side). The action 51 comprises a wippen 52 carried on the rear end of the key 50; a jack 53 pivotably arranged on the wippen 52; and a regulating button 56 disposed at a predetermined position above the wippen 52. The jack 53 is formed in L-shape with a regulating button contact protrusion 54 extending in the front-to-rear direction, and a hammer push-up rod 55 extending upward substantially at right angles with the rear end of the regulating button contact protrusion 54, and is pivotably supported by the wippen 52 at the corner of both members 54, 55. Also, in the key released state, the hammer push-up rod 55 is in engagement with a bat 61 of a hammer 60, and the regulating button contact protrusion 54 has a regulating button contact surface 54*a* opposing a regulating button 56 from below. The regulating button contact surface 54*a* is formed in a curved surface. The bat 61 is arranged such that a hammer shank 62 extends upward therefrom, and a hammer head (not shown) of the hammer 60 is mounted to the upper end of the hammer shank 62. Also, the bat 61 is provided with a bat spring 61*a* for urging the hammer 60 in the clockwise direction in FIG. 1.

As the key 50 is depressed in the upright piano as described above, the wippen 52 is pushed up by the rear end of the key 50 to pivotally move upward, causing the jack 53 to move up together with the wippen 52. In this way, the hammer 60 is pushed up by the jack 53 through the bat 61, and pivotally moves toward a vertically stretched string (not shown) in the rear against an urging force of the bat spring 61*a*. Then, as the regulating button contact protrusion 54 of the jack 53 comes into contact with a regulating button 56, the jack 53 is prevented from moving up. As the wippen 52 further pivotally moves, the regulating button contact protrusion 54 of the jack 53 pivotally moves with respect to the wippen 52 while sliding along the lower surface of the regulating button 56, with a counter-force from the regulating button 56 acting on the jack 53, resulting in the jack 53 coming off the hammer 60. Consequently, the weight of the hammer 60 is lost from a touch weight (a load applied on a finger tip) of the key 50, giving a let-off feeling to a player. After the jack 53 has come off the hammer 60, the hammer 60 strikes an associated string with the inertia.

Generally, for rich play representations, it is important to correctly pinpoint a timing at which the jack 53 comes off the hammer 60, i.e., a let-off timing to finely adjust the speed at which the hammer 60 strikes the string. For example, a weak sound such as pianissimo can be generated by once bringing the hammer 60 to the vicinity of the string and letting it swing from that position to reduce the string striking speed of the hammer 60. In other words, a weak sound can be generated by once depressing the key 50 to immediately before let-off at which the jack 53 comes off the hammer 60, and pushing down the key 50 from that state.

On the other hand, in the upright piano which employs the conventional action, the hammer shank 62 extends vertically as mentioned above, so that the center of gravity of the hammer 60 is positioned near the fulcrum of its swinging movements, resulting in small moment about the fulcrum of the swinging movements produced by the self weight of the hammer 60. For this reason, a let-off load, which is a touch weight immediately before the let-off, is relatively small, and the touch weight varies only by a small amount before and after the let-off, thus experiencing difficulties in pinpointing the timing of the let-off. As a result, the piano is degraded in its capabilities of expressions and playing performance due to difficulties in finely adjusting the string striking speed of the hammer 60.

Also, high sequentially touching capabilities are also required for rich playing expressions. In a grand piano, the hammer extends substantially horizontally, with its center of gravity positioned near a hammer head spaced largely from the fulcrum of pivotal movements at one end of the hammer in the horizontal direction. Thus, the hammer, after striking a string above, promptly swings by its own weight to return to a position at which it can be again pushed up by the jack, with the result that the grand piano provides high sequentially touching capabilities. On the other hand, in the aforementioned upright piano, since the hammer 60, after striking the string, is swung by an urging force of the bat spring 61*a* to return, a relatively long time is taken for the hammer 60 and jack 53 to return to a state in which the hammer 60 can be again pushed up, resulting in lower sequentially touching capabilities of the upright piano than the grand piano. For improving the sequentially touching capabilities of the upright piano, it is contemplated to enhance the spring force of the bat spring 61*a* to reduce a time for the hammer 60 to swing back to the position at which it can be again pushed up by the jack 53. In this strategy, however, the touch weight is increased by the enhanced spring force when the hammer 60 is pushed up by the jack 53, resulting in adverse affections exerted on the touch feeling.

SUMMARY OF THE INVENTION

The present invention has been made to solve the problem as mentioned above, and it is an object of the invention to provide an action for a piano which is capable of clarifying a timing of let-off, improving the sequentially touching capabilities, and consequently realizing high playing performance excellent in expressive power in a simple structure without adversely affecting the key touch feeling.

To achieve the above object, the present invention provides an action for a piano, configured to actuate in response to a depression on a key to swing a hammer which strikes a string. The action is characterized by comprising a wippen pushed up by the key when the key is depressed to pivotally move upward; a regulating button having a flat jack contact surface on a lower end, and fixed to a predetermined position above the wippen; and a jack having a regulating button contact protrusion including a flat regulating button contact surface on an upper end, and arranged on the wippen for pivotal movement about a jack fulcrum to engage with the hammer such that a pivotal movement of the wippen causes the jack to push up the hammer, wherein the jack is configured to pivotally move relative to the wippen to come off the hammer by the regulating button contact surface coming into contact with the jack contact surface during the pivotal movement.

According to the action for a piano described above, the jack is in engagement with the hammer in a key released state. As the key is depressed from this state, the wippen is pushed up by the key to pivotally move upward, and the jack moves up together with the wippen. In this way, the hammer is pushed up by the jack to swing. During this pivotal movement of the wippen, the regulating button contact surface of the jack comes into contact with the jack contact surface of the regulating button, thereby preventing the jack from moving up. Then, as the wippen pivotally moves more and more, the jack pivotally moves relative to the wippen, while the regulating button contact protrusion is sliding along the jack contact surface, with a counter-force acting on the jack from the regulating button. When the pivotal movement reaches a predetermined amount, the jack comes off the hammer. Subsequently, the hammer swings with inertia to strike a string.

As described above, after coming into contact with the regulating button, the jack pivotally moves relative to the wippen, while its regulating button contact protrusion is sliding along the jack contact surface, with the counter-force acting from the regulating button. The counter-force of the regulating button in this event is transmitted to the key through the jack and wippen, resulting in a corresponding increase in tough weight. In this sequence of operations, since both the regulating button contact surface and jack contact surface are both flat in the present invention, the regulating button contact surface comes into planar contact with the jack contact surface, to increase the contact area of both, as compared with the aforementioned conventional regulating button contact surface which is curved, resulting in a larger frictional resistance between the regulating button contact protrusion and the regulating button. This makes the regulating button contact protrusion difficult to slide along the jack contact surface to cause consequent difficulties in the pivotal movement of the jack. Thus, the counter-force of the regulating button, transmitted through the jack and wippen, is further increasing until the jack comes off. This results in a larger touch weight immediately before let-off, i.e., a larger let-off load, and a larger amount of change in the touch weight before and after the let-off, thereby making it possible to clarify the timing of the let-off. In response to the thus clarified timing of the let-off, the player can finely adjust a string striking speed of the hammer to realize high playing performance excellent in expressive power. Also, the foregoing advantageous effects can be provided in a simple structure only including the flat jack contact surface and flat regulating button contact surface.

Preferably, in the action for a piano described above, the regulating button contact surface is angled such that the regulating button contact surface comes into planar contact with the jack contact surface.

According to this preferred embodiment of the action for a piano, the regulating button contact surface comes into tightly planar contact with the jack contact surface without fail. This causes the generation of a large frictional resistance between the regulating button contact protrusion and the regulating button, which makes the jack difficult to pivotally move, and increases the let-off load, thus making it possible to ensure the advantageous effects mentioned above.

Preferably, the action for a piano described above further comprises a sheeted damping material on at least one of the jack contact surface or the regulating button contact surface, wherein the regulating button contact surface is angled such that when the regulating button contact surface comes into contact with the jack contact surface through the damping material, the regulating button contact surface comes into contact with an end of the jack contact surface close to the jack fulcrum, and the regulating button contact surface extends obliquely in close proximity to the jack contact surface.

According to this preferred embodiment of the action for a piano, during a pivotal movement of the wippen associated with a depression on the key, the regulating button contact surface of the regulating button contact protrusion comes into contact with the jack contact surface through the sheeted damping material, causing the jack to pivotally move relative to the wippen. Also, when this contact is made, the regulating button contact surface comes into contact with the end of the jack close to the jack fulcrum, and extends obliquely in close proximity to the jack contact surface, i.e., comes into contact with the jack contact surface at a slight angle formed thereto. In this event, as the intervening sheeted damping material is compressed, a combination of the end of the regulating button contact surface close to the jack fulcrum and its vicinity is in contact with planar contact with the jack contact surface through the damping material, thereby ensuring a larger frictional resistance. Further, such a planar contact causes the center of the planar contact, i.e., a point acted by the counter-force from the regulating point, to be near the jack fulcrum, resulting in a larger counter-force of the regulating button required for the pivotal movement of the jack. Thus, according to the present invention, the let-off load is increased by a larger frictional resistance ensured by the planar contact, and the counter-force of the regulating button acting on a position closer to the jack fulcrum, thus ensuring the advantageous effects of the action described above.

Preferably, in the action for a piano described above, the jack includes a hammer push-up rod extending upward from the jack fulcrum, and configured to engage with the hammer, and the hammer push-up rod includes a prominence formed along an edge of a top surface thereof opposite to the regulating button contact protrusion.

According to this preferred embodiment of the action for a piano, the top surface of the hammer push-up rod, extending upward from the jack fulcrum, slides along the bottom of the hammer toward the regulating button in association with the pivotal movement of the jack which is accompanied with a depression on the key. Also, since the prominence is formed along an edge of a top surface thereof opposite to the regulating button contact protrusion, this prominence serves as a resistance when the jack slides along the hammer, thus making the jack difficult to come off the hammer. This can result in a further increase in the let-off load and a more clarified timing of the let-off.

Preferably, in the action for a piano described above, the jack comprises a molding formed of a synthetic resin.

According to this preferred embodiment of the action for a piano, the jack can be molded with a high accuracy, and therefore, the regulating button contact surface and the prominence on the hammer push-up rod can be readily formed into respective desired shapes with a high accuracy, and a desired relationship can be readily established in the position and angle with respect to the jack contact surface. Also, since the jack is made of a synthetic resin, advantages of the synthetic resin can be provided, including a high machining accuracy and dimensional stability.

Preferably, in the action for a piano described above, the jack comprises a molding molded by a long-staple method and made of a thermoplastic resin containing long fibers for reinforcement.

According to this preferred embodiment of the action for a piano, the jack comprises a molding molded by the long-staple method and made of a thermoplastic resin containing long fibers for reinforcement. Here, the long-staple method involves injection molding of a pellet containing fibrous reinforcing materials of the same length covered with a thermoplastic resin to produce moldings. According to the long-staple method, relatively long fibrous reinforcing materials having a length of 0.5 mm, for example, are contained in the moldings. Thus, the jack contains the relatively long fibers for reinforcement and can accordingly exhibit a very high rigidity, as compared with a jack made of a synthetic resin.

As a result, the jack can be reduced in weight than before, while ensuring a required rigidity. In this event, since the jack can be rapidly returned to a state in which it can again push up the hammer in response to a released key, the sequentially touching capabilities can be improved to realize high playing performance excellent in expressive power, without adversely affecting a touch feeling of the key.

Preferably, in the action for a piano described above, the long fibers are carbon fibers.

Dust sticking to movable parts of the action can cause their slow motions which can degrade the responsibility of the action. Also, in general, the carbon fiber is more electrically conductive than other long fibers for reinforcement, for example, glass fiber. Thus, by containing such carbon fibers in the thermoplastic resin, by which the jack is made, as long fibers for reinforcement, the jack can be improved in conductivity to reduce its electrostatic property. Consequently, since the reduced electrostatic property restrains dust from stacking to the jack, the jack can provide consistently good movements and responsibility. Also, the dust restrained from sticking to the jack can keep the appearance of the jack clear and prevent the operator's hands and clothing from being soiled in operations for adjusting the action and the like.

Preferably, in the action for a piano described above, the thermoplastic resin is an ABS resin.

Since the ABS resin exhibits a small molding contraction ratio among resins, the use of the ABS resin can improve the machining accuracy and restrain variations in dimensions of the respective jacks.

Generally, when a thermoplastic resin containing a reinforcing material such as carbon fiber is injection molded at a high melt flow rate, the thermoplastic resin flows into a mold at higher speeds, causing a higher susceptibility to anisotropy in rigidity of the molding due to the reinforcing material tending to align in a particular direction in the molding. The ABS resin is a thermoplastic resin containing a rubber-like-polymer, and can be molded at a low melt flow rate. Accordingly, when the jack is made of the ABS resin as described above, the jack can be restrained in anisotropy and consistently provide a high rigidity. Further, the ductility exhibited by the ABS resin can enhance the impact strength of the jack.

DETAILED DESCRIPTION OF THE PREFERRED EMBODIMENTS

In the following, an action according to one embodiment of the present invention will be described with reference to the accompanying drawings.

Figure 2:
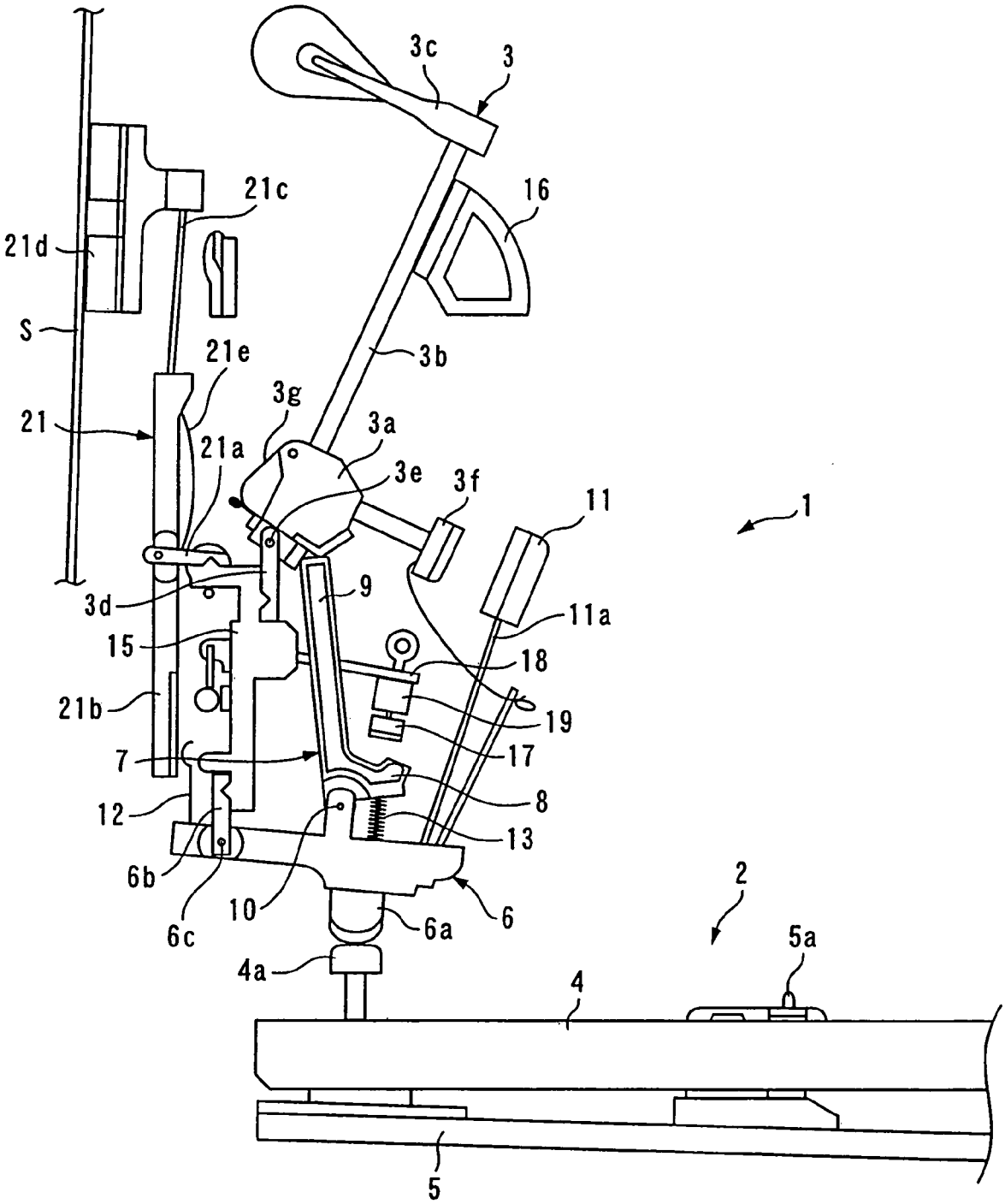
FIG. 2 is a side view illustrating an action according to a first embodiment of the present invention together with associated components in a key released state.

FIG. 2 illustrates an action 1, a keyboard 2, a hammer 3 and the like of an upright piano according to a first embodiment of the present invention in a key released state. The keyboard 2 comprises a large number of keys 4 (only one of which is shown) arranged side by side from left to right (in a depth direction in FIG. 2), and each key 4 is swingably supported by a fulcrum which is a balance pin 5*a* implanted on a keybed 5.

The action 1 is attached to a left and a right bracket (none of which is shown) arranged at a left and a right end of the keybed 5 above the rear end of the keyboard 2, and arranged to extend between both the brackets. The action 1 also comprises a wippen 6 and a jack 7 which are provided for each key 4 (only one each of them is shown). Further, a center rail 15 and a hammer rail 16 are extended between the left and right brackets.

The wippen 6, which is formed, for example, of synthetic resin in a predetermined shape, has a heel 6*a* extending downward from the front, and is carried on a capstan button 4*a* arranged on the top surface of a corresponding key 4 in a rear end area through the heel 6*a*. The wippen 6 is pivotably attached to a wippen flange 6*b* fixed on the center rail 15 through a pin-shaped fulcrum 6*c*. A back check wire 11*a* is implanted on the top surface of the wippen 6 in a front end area, and a back check 11 is attached to a leading end thereof. A spoon 12 is also implanted on the wippen 6 in an area behind the fulcrum 6*c* for driving a damper 21, later described.

The jack 7, which is formed by a long-staple method, is injection molded using a pellet as described below. This pellet is manufactured by covering lobings made of carbon fiber with a thermoplastic resin containing a rubber-like polymer, for example, an ABS resin, which is one type of synthetic resin, extruded by an extruder, while the lobings are made even with a predetermined tension applied thereto. In this way, the lobings of carbon fiber can be contained in the pellet when it is molded without bending the lobings, so that the pellet contains carbon fibers which are equal in length to the pellet. In this embodiment, the length of the pellet is set in a range of 5 to 15 mm, whereby carbon fibers of 0.5 to 2 mm long are contained in the jack 7 which is injection molded using the pellet. A melt flow rate is set to a relatively small value for the aforementioned rubber-like polymer, for example, in a range of 0.1 to 50 g per 10 minutes under a testing condition including the temperature of 230° C. and a load of 2.12 kg.

Figure 3:
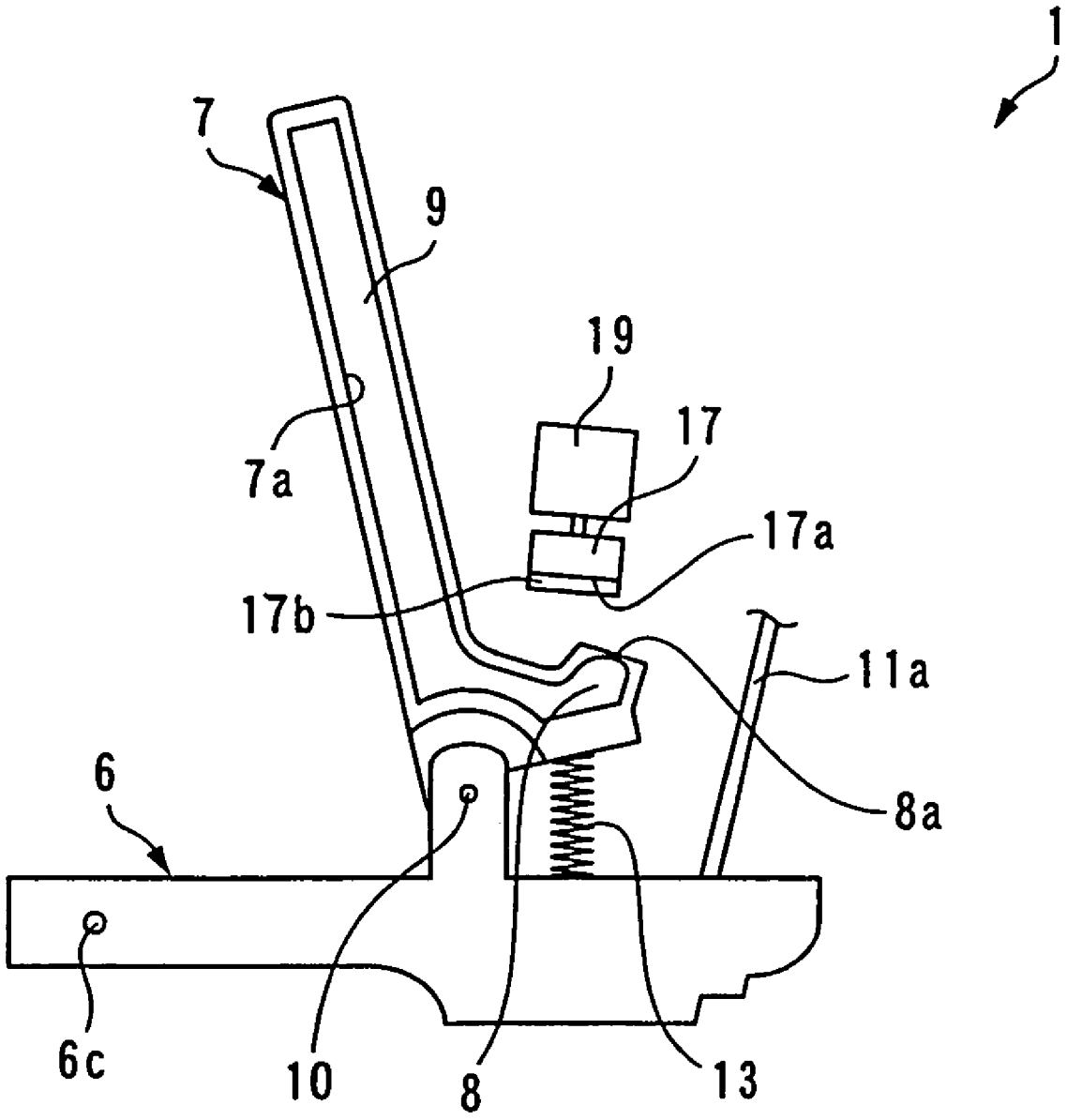
FIG. 3 is a partially enlarged view illustrating a jack of the action in FIG. 2 together with associated components in the key released state.

The jack 7, which is formed in an L-shape by the long-staple method as described above, comprises a regulating button contact protrusion 8 extending in a front-to-back direction, and a hammer push-up rod 9 extending upward from the rear end of the regulating button contact protrusion 8 and longer than the regulating button contact protrusion 8, as illustrated in FIG. 3. Also, the jack 7 is pivotably attached at a central area of the wippen 6 through a pin-shaped jack fulcrum 10 at the corner between the regulating button contact protrusion 8 and the hammer push-up rod 9. The regulating button contact protrusion 8 has a front end which slightly protrudes upward, and a top end which serves as a flat regulating button contact surface 8*a* that is inclined at a predetermined angle, as will be later described. Also, the jack 7 is formed with a recess 7*a* substantially entirely on each of the left and right side surfaces for reducing the weight. A jack spring 13 is provided between the regulating button contact protrusion 8 of the jack 7 and the wippen 6 for returning the jack 7 when the key 4 is released.

A regulating button 17 is arranged above the regulating button contact protrusion 8 of the jack 7. The regulating button 17 is provided for each key 4 through a plurality of regulating brackets 18 (only one of which is shown) disposed on the center rail 15, and a regulating rail 19 which is attached to the front end thereof and extends from left to right. The lower end of the regulating button 17 serves as a flat jack contact surface 17*a* which opposes the regulating button contact surface 8*a* of the jack 7 in the key released state. The jack contact surface 17*a* slightly inclines downward in front at a predetermined angle to the horizontal line. A sheeted punching 17*b* (damping material) made, for example, of felt is adhered to the jack contact surface 17*a*.

The hammer 3 comprises a bat 3*a*, a hammer shank 3*b*, and a hammer head 3*c*. The bat 3*a* is pivotably attached to a bat flange 3*d* fixed to the center rail 15 through a pin-shaped fulcrum 3*e*, thereby permitting the hammer 3 to swing. The hammer shank 3*b* extends upward from the bat 3*a*, and the hammer head 3*c* is attached to the upper end thereof. In the key released state, the hammer head 3*c* opposes a string S vertically stretched behind the hammer head 3*c*. A catcher 3*f* is attached to the front surface of the bat 3*a*. The catcher 3*f* is positioned behind and opposes the aforementioned back check 11 in the key released state. Also, the bat 3*a* is provided with a bat spring 3*g* which urges the hammer 3 in the clockwise direction in FIG. 2. In the key released state, the hammer push-up rod 9 of the jack 7 is in engagement with the bat 3*a* from below.

A damper 21 is provided for each key 4 behind the action 1. The damper 21 comprises a damper lever 21*b* pivotably attached to the center rail 15 through a damper flange 21*a*, a damper head 21*d* attached to the upper end of the damper lever 21*b* through a damper wire 21*c*, a damper lever spring 21*e* for urging the damper head 21*d* toward the string S. The damper 21 is provided to stop sound by the damper head 21*d* which is brought into contact with the string S by an urging force of the damper lever spring 21*e* when the key 4 is released.

Next, a description will be given of a sequence of operations performed by the action 1, hammer 3 and the like from the start to the end of a key depression. As a player touches the released key 4, the key 4 pivotally moves in the clockwise direction in FIG. 2 to push up the wippen 6 carried in the rear end area thereof, thereby causing the same to pivotally move upward (counter-clockwise direction) about the fulcrum 6*c*. Associated with the pivotal movement of the wippen 6, the jack 7 moves up together with the wippen 6, and the hammer 3 is pushed up by the hammer push-up rod 9 of the jack 7 to swing toward the string S, positioned behind, in the counter-clockwise direction.

Figure 4:
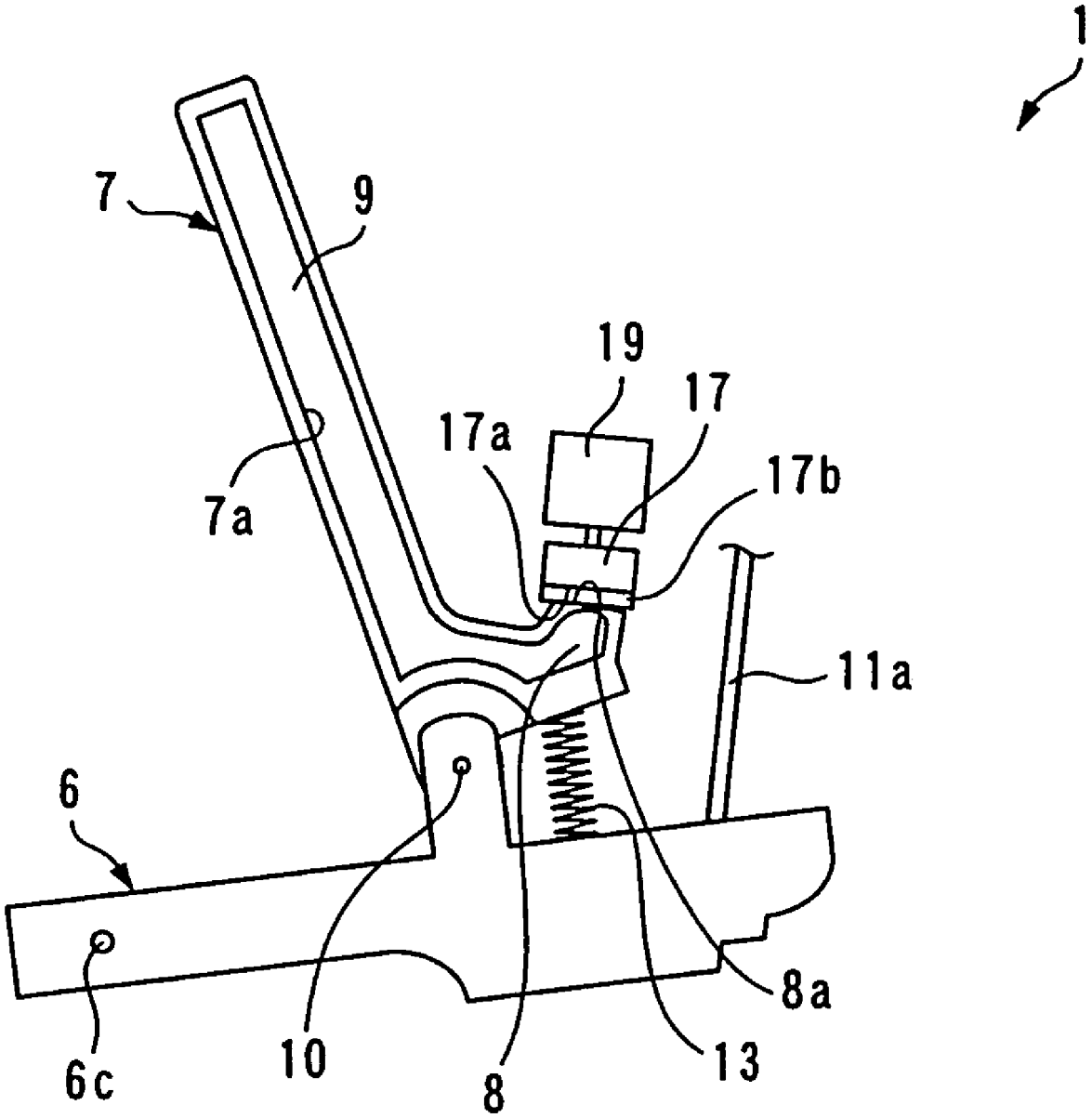
FIG. 4 is a side view illustrating the jack of the action in FIG. 2 together with associated components when a regulating button contact surface comes into contact with a jack contact surface through a punching.
Figure 5:
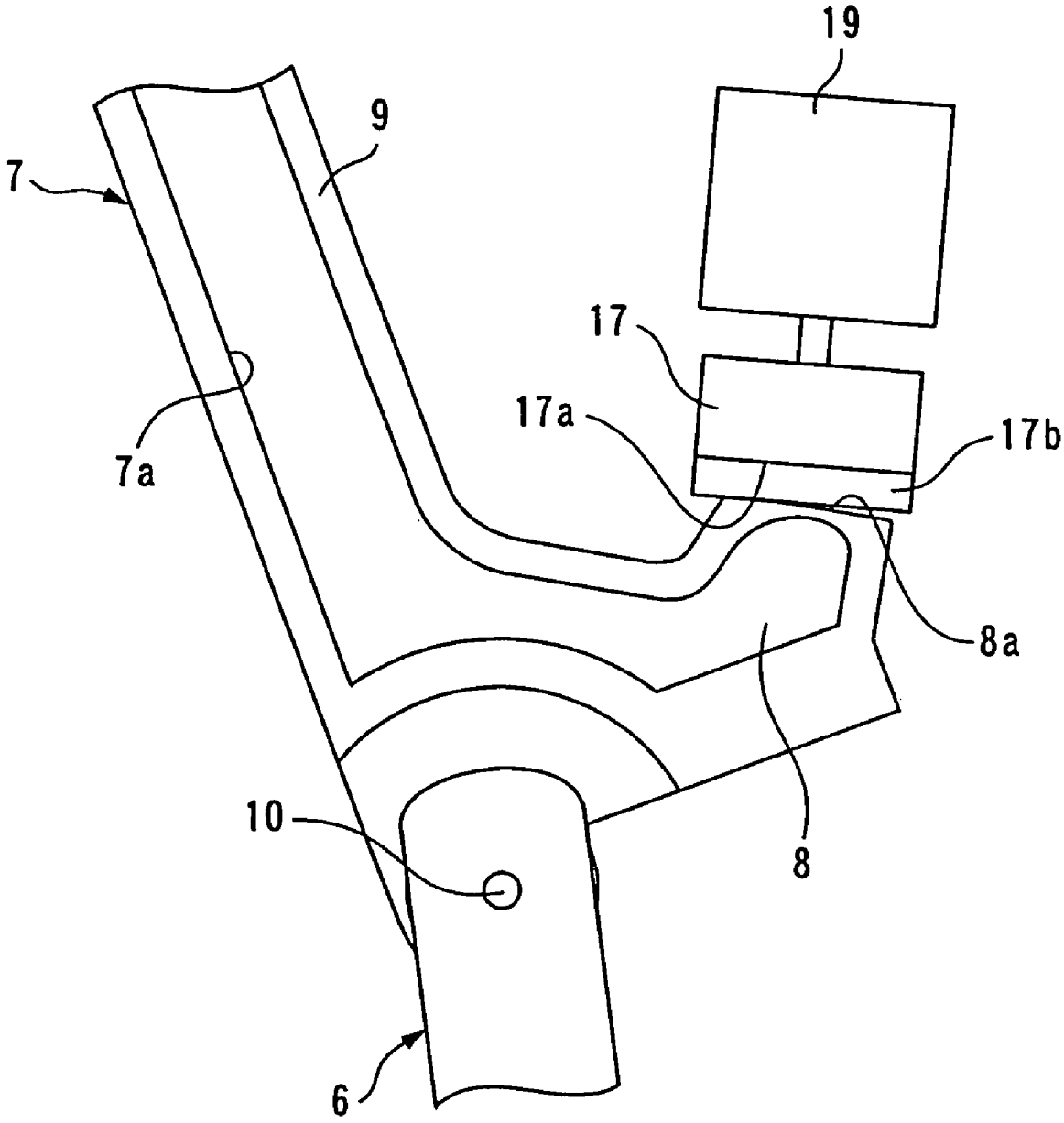
FIG. 5 is a partially enlarged view of FIG. 4.

Then, as illustrated in FIG. 4, when the wippen 6 has pivotally moved over a predetermined angular distance, the regulating button contact protrusion 8 of the jack 7 comes into contact with the regulating button 17 to prevent the jack 7 from moving up. When this contact is made, as illustrated in FIG. 5, the regulating button contact surface 8*a* comes into contact with the jack contact surface 17*a* through the punching 17*b* at its rear end, and extends obliquely in close proximity to the jack contact surface 17*a*, that is, obliquely comes into contact with the jack contact surface 17*a* with a slight angle thereto. Also, as the punching 17*b* is compressed by this contact, the rear area of the regulating button contact surface 8*a* is in planar contact with the jack contact surface 17*a* through the punching 17*b*. In this way, when in contact with the regulating button 17, a portion of the regulating button contact surface 8*a* near the jack fulcrum 10 is in planar contact with the jack contact surface 17*a* through the punching 17*b*.

Then, as the key 4 is depressed more and more to cause the wippen 6 to further pivotally move, the jack 7 pivotally moves relative to the wippen 6 in the counter-clockwise direction against the urging force of the jack spring 13, while the regulating button contact protrusion 8 slides along the punching 17*b*. Also, with this pivotal movement of the jack 7, the top of the hammer push-up rod 9 slides in front along the bottom of the bat 3*a*.

Then, when the jack 7 has pivotally moved by a predetermined amount, the hammer push-up rod 9 comes off the bat 3*a* in front, causing the jack 7 to leave the hammer 3. Subsequently, the hammer 3 swings with inertia to strike the string S, thus generating a play sound. Also, as the jack 7 leaves the hammer 3 to suddenly reduce a touch weight of the key 4 by the weight of the hammer 3, the player is given a let-off feeling. After striking the string S, the hammer 3 returns by a swinging movement in the clockwise direction caused by a repellent force of the string S and the urging force of the bat spring 3*g*, and once stops its operation with the catcher 3*f* held by the back check 11.

Then, as the key 4 is released after the key touch, the key 4 and wippen 6 pivotally move in the opposite directions to those when the key 4 is depressed. This pivotal movement of the wippen 6 for returning causes the back check 11 to leave from the catcher 3*f*, permitting the hammer 3 to swing in the clockwise direction to bring the hammer shank 3*b* into contact with the hammer rail 16. Also, with the pivotal movement of the wippen 6 for returning, the jack 7 is released from the contact with the regulating button 17, and as a result, the jack 7 returns by a pivotal movement in the counter-clockwise direction made by the urging force of the jack spring 13. In this event, A reduction in weight of the jack 7 prompts the same to pivotally move in the counter-clockwise direction to return, associated with the pivotal movement of the wippen 6 and the like for returning. With this pivotal movement, the upper rear corner of the hammer push-up rod 9 comes into contact with the bat 3*a*, and then slides backward along the bottom of the bat 3*a*, and enters below and engages with the bat 3*a*, permitting the jack 7 to return to the original position in the key released state. In the foregoing manner, the key 4, wippen 6, hammer 3, and jack 7 return to the original key released state, thus completing a sequence of key depressing and key releasing operations.

When the key 4 is sequentially touched, the key 4 is repeatedly touched before the hammer 3, wippen 6 and the like completely return to the key released state. In this event, the jack 7 likewise pivotally moves in the counter-clockwise direction to promptly return, resulting from the pivotal movement of the wippen 6 for returning, before the key 4 is touched the next time. Therefore, even when the key 4 is sequentially touched, the jack 7 follows the key touch without delay, and pushes up the hammer 3 without fail to strike the string S each time the key 4 is touched.

Figure 1:
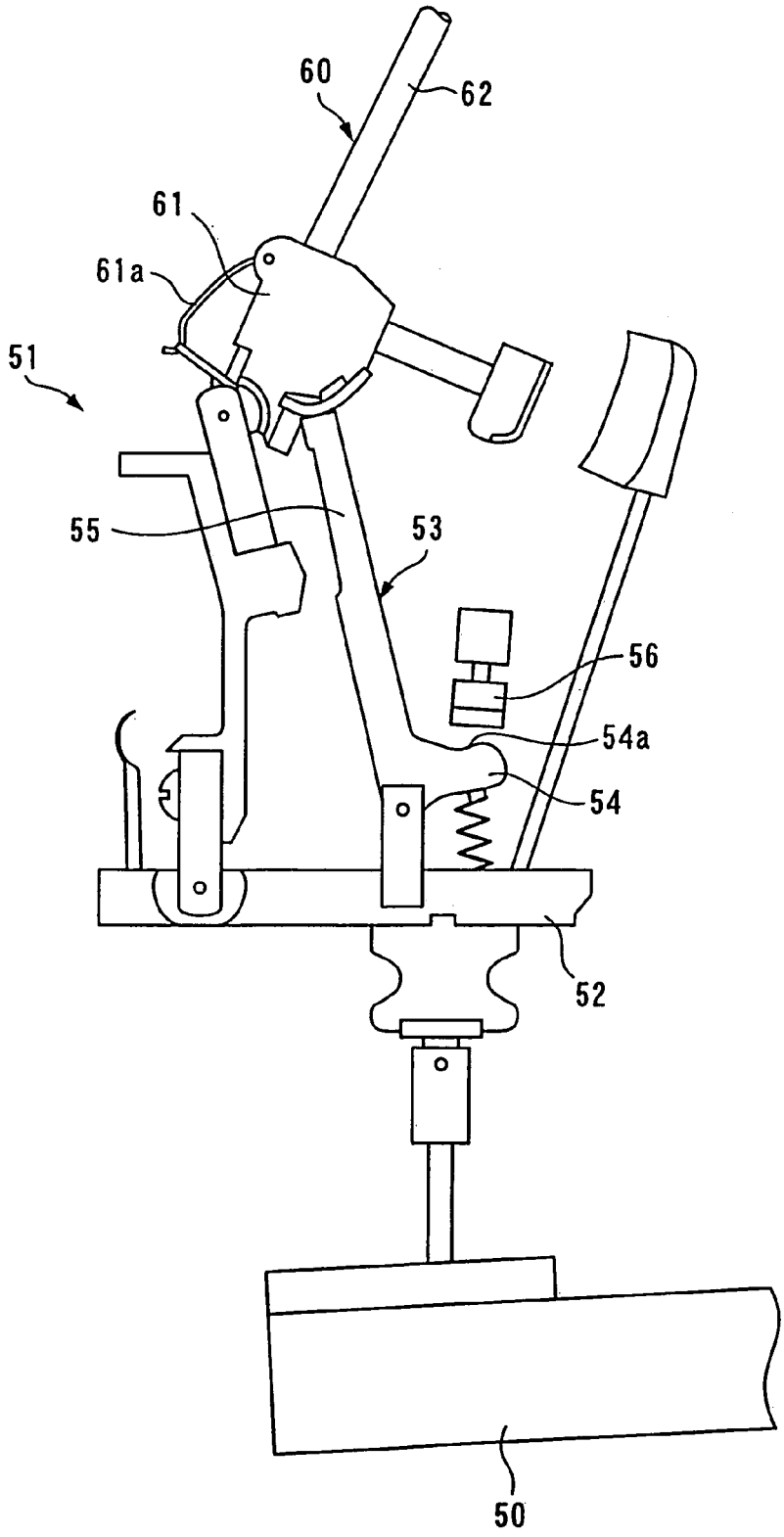
FIG. 1 (PRIOR ART)
FIG. 1 is a side view illustrating main components of a conventional action in a key released state.
Figure 6:
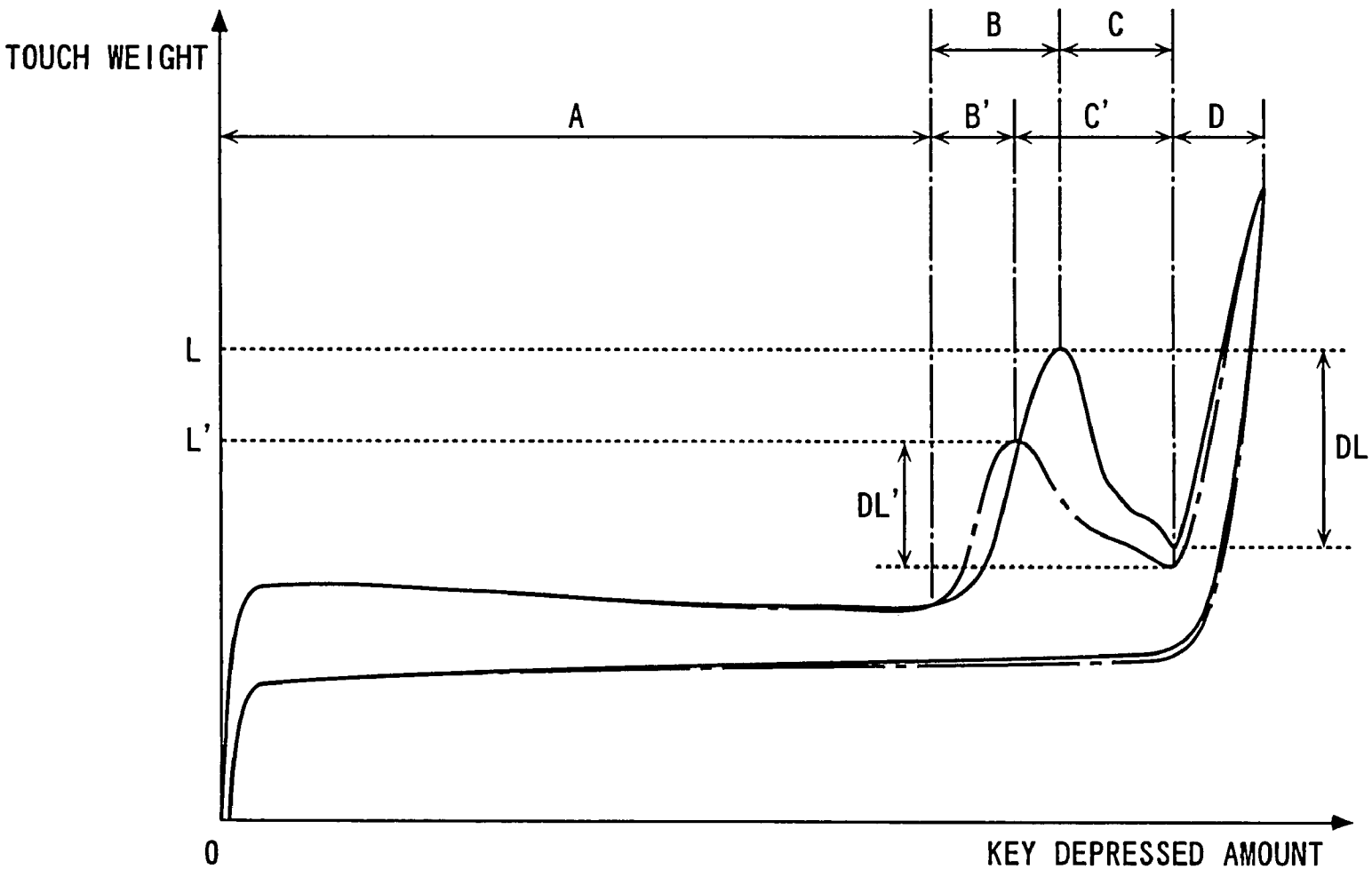
FIG. 6 is a diagram showing the relationship between a key depressed amount and a touch weight when the action of FIG. 2 is used, together with a comparative example.

FIG. 6 shows the relationship between a key depressed amount and a touch weight when the action of FIG. 2 is used, together with a comparative example. The comparative example shows such a relationship when the regulating button contact surface 8 is curved in a similar manner to the prior art described above in connection with FIG. 1.

As shown in FIG. 6, in either of this embodiment (indicated by a solid line) and the comparative example (indicated by a one-dot-chain line), the touch weight substantially levels at a magnitude in accordance with the moments about the fulcrums 5*a*, 6*c*, 3*e* by the respective self-weights of the key 4, action 1, and hammer 3 from the time the key 4 is touched to the time the jack 7 comes into contact with the regulating button 17 (in a section A in FIG. 6).

Also, as the key 4 is depressed more and more to bring the jack 7 into contact with the regulating button 17, the touch weight suddenly increases due to the action of a counter-force from the regulating button 17 in addition to the moment produced by the self weight of the action 1 and the like (sections B, B'). Then, as the jack 7 comes off the hammer 3, the touch weight suddenly decreases due to a sudden loss of the weight of the hammer 3 (sections C, C'). In this event, in the comparative example, since the regulating button contact surface 8*a* is curved, a let-off load L' immediately before the jack 7 comes off the hammer 3, and the amount DL' of change in the touch weight before and after the let-off are smaller than those of this embodiment. As the front end of the key 4 comes into contact with the front rail (not shown) of the keybed 5 to prevent the key 4 from further pivotally moving to terminate the key touch, the touch weight suddenly increases due to a counter-force from the keybed 5 (section D).

On the other hand, in the action 1 of this embodiment, when the regulating button 17 comes into contact with the jack 7, a portion of the regulating button contact surface 8*a* close to the jack fulcrum 10 comes into planar contact with the jack contact surface 17*a* through the punching 17*b*, as described above. With a large frictional resistance ensured by the planar contact, and the counter-force of the regulating button 17 acting on a point near the jack fulcrum 10, the let-off load L of this embodiment is larger than the let-off load L' of the comparative example, and the amount DL of change in the touch weight before and after the let-off is also larger than the amount DL' of change in the comparative example. Thus, according to this embodiment, the timing of the let-off can be clarified by increasing the let-off load and the amount of change in the touch weight before and after the let-off, making it possible to realize high playing performance excellent in expressive power. In addition, such an advantageous effect can be achieved in a simple structure of the regulating button contact surface 8*a* and jack contact surface 17*a* which are made flat.

Also, since the jack 7 comprises a molding made of an ABS resin which exhibits a small molding contraction ratio among resins, the jack 7 can be improved in machining accuracy, thus making it possible to accurately and readily form the regulating button contact surface 8*a* into a desired shape, and to readily set a desired relationship between the regulating button contact surface 8*a* and jack contact surface 17*a* with respect to the position and angle. It is also possible to restrain variations in dimensions of the respective jacks 7.

The jack 7 has a very high rigidity because it is formed by the long-staple method and contains long fibers for reinforcement. This permits the formation of the left and right recesses 7*a* to reduce the weight of the jack 7, as compared with before, while ensuring a required rigidity. As a result, the jack 7 itself can be promptly returned to a state in which it can again push up the hammer 3, in response to a release of the key 4.

Also, since the jack 7 is reduced in weight, the jack 7 can promptly return to a state in which it can push up the hammer 3 by the time the key 4 is touched the next time even when the key 4 is sequentially touched. Therefore, even with rapid sequential touches, the jack 7 can follow the key touches without delay, and can push up the hammer 3 without fail each time the key 4 is touched to strike the string S. It is therefore possible to improve the performance of the key 4 when it is sequentially touched to realize high playing performance excellent in expressive power. Though not discussed in detail, the jack 7 of this embodiment is reduced in weight by approximately 0.065 g, as compared with a conventional jack made of a synthetic resin (e.g. ABS resin) not containing long fibers, and having the same shape and size, and as the result, it is confirmed that the key 4 is improved in the sequentially touching capabilities by approximately 1.2 times per second.

Also, since the jack 7 contains long carbon fibers in the ABS resin for reinforcement, the jack 7 is improved in conductivity to reduce its electrostatic property. Since the reduced electrostatic property restrains dust which could stick to the jack 7, the jack 7 can provide consistently good movements and responsibility. Also, the dust restrained from sticking to the jack can keep the appearance of the jack 7 clear and prevent the operator's hands and clothing from being soiled in operations for adjusting the action 1 and the like.

Generally, when a thermoplastic resin containing a reinforcing material such as carbon fiber is injection molded at a high melt flow rate, the thermoplastic resin flows into a mold at higher speeds, causing a higher susceptibility to anisotropy in rigidity of the molding due to the reinforcing material tending to align in a particular direction in the molding. In this embodiment, on the other hand, since the jack 7 is made of an ABS resin which is a thermoplastic resin containing a rubber-like polymer and can be molded at a low melt flow rate, the jack 7 can be restrained in anisotropy and consistently provide a high rigidity. Further, the ductility exhibited by the ABS resin can enhance the impact strength of the jack 7.

Figure 7:
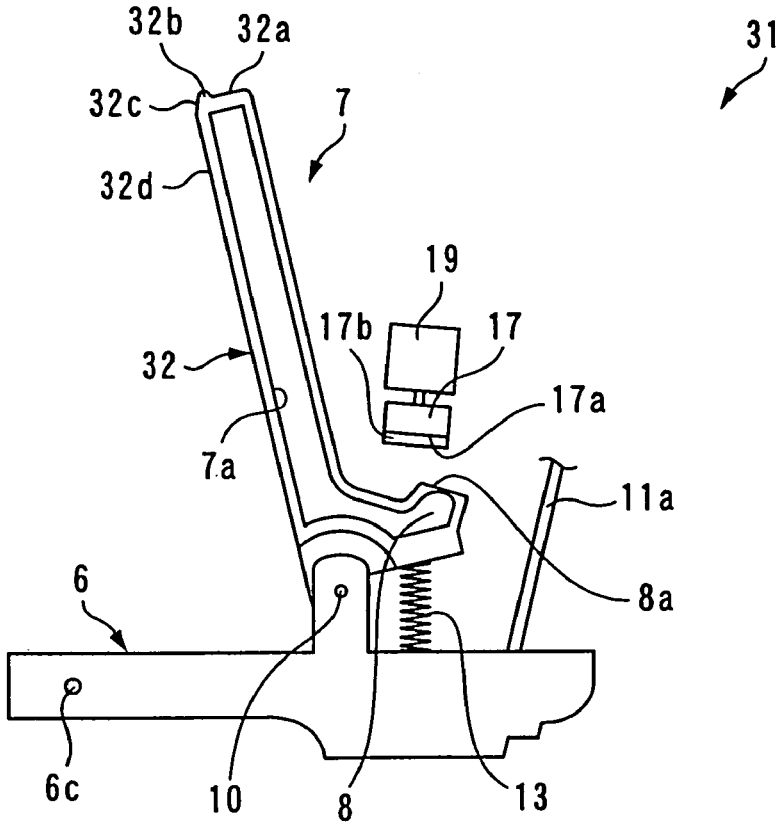
FIG. 7 is a side view illustrating a jack of an action according to a second embodiment together with associated components in a key released state.
Figure 8:
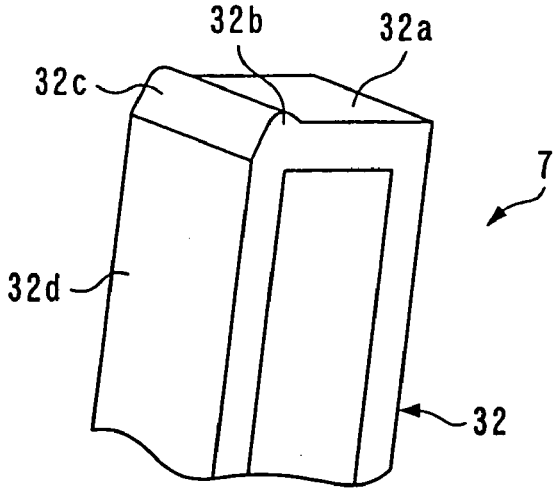
FIG. 8 is a partially enlarged view of a hammer push-up rod in FIG. 7.

Next, an action according to a second embodiment of the present invention will be described with reference to FIGS. 7 and 8. The action 31 is basically similar in structure to the action 1 of the first embodiment except for the structure of a hammer push-up rod 32 of the jack 7. The hammer push-up rod 32 is formed with a prominence 32*b* across the rear end edge of the top surface 32*a* in the left-to-right direction. The prominence 32*b*, which is substantially in a triangular shape, slightly protrudes upward from the top surface 32*a*, and has a curved peak. The hammer push-up rod 32 is also formed with an inclined surface 32*c* behind the prominence 32*b*. This inclined surface 32*c* extends obliquely from the peak of the prominence 32*b* to the top surface 32*a* of the hammer push-up rod 32, and crosses to the back 32*d* of the hammer push-up rod 32.

Since the prominence 32*b* is formed along the rear end edge of the top surface 32*a* of the hammer push-up rod 32 in the manner described above, the prominence 32*b* acts as a resistance at the time of a let-off at which the jack 7 comes off the hammer 3 during a key depression, thereby making the jack 7 more difficult to come off the hammer 3. In this way, the let-off load is further increased to even more clarify the timing of the let-off.

Also, the inclined surface 32*c* is formed behind the prominence 32*b* of the hammer push-up rod 32, and the inclined surface 32*c* extends long from the peak of the prominence 32*b* to the back 32*d*. This inclined surface 32*c* permits the hammer push-up rod 32 to smoothly slip into below the bat 3*a* without being caught thereby. This can improve the sequentially touching capabilities of the key 4. Further, since the jack 7 is a molding made of a synthetic resin, the prominence 32*b* and inclined surface 32*c* of the hammer push-up rod 32 can be readily formed in desired shapes with a high accuracy.

Figure 9:
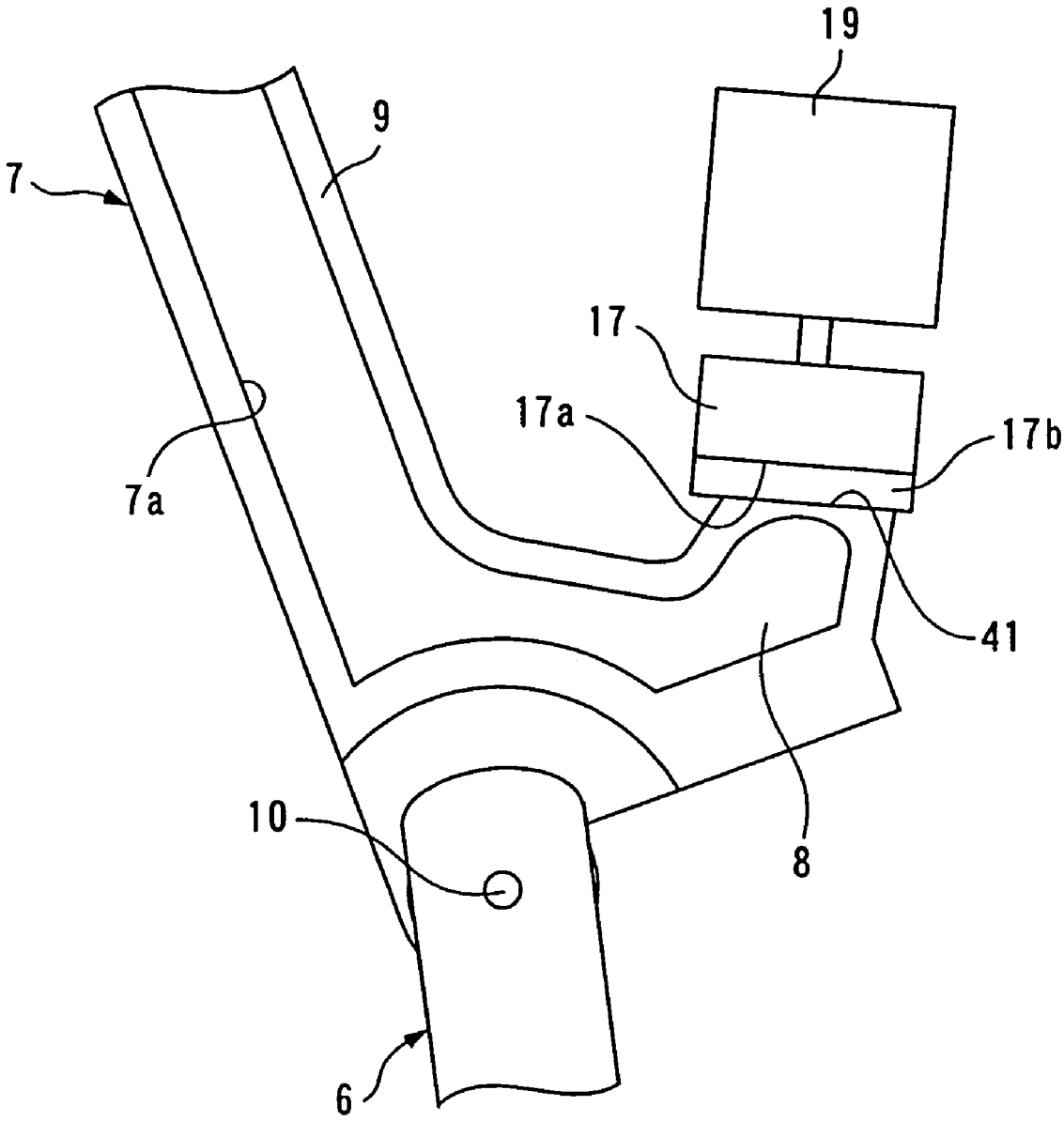
FIG. 9 is a partially enlarged side view illustrating a jack of an action according to a third embodiment together with associated components when a regulating button contact surface comes into contact with a jack contact surface through a punching.

Next, an action according to a third embodiment of the present invention will be described with reference to FIG. 9. This action differs from the action 1 of the first embodiment only in the angle of the regulating button contact surface 41. As illustrated in FIG. 9, the angle of the regulating button contact surface 41 is set such that the entirety of the regulating button contact surface 41 comes into perfectly planar contact with the jack contact surface 1 when they are brought into contact. This results in a larger contact area which generates a larger frictional resistance between the regulating button contact protrusion 8 and regulating button 17, thereby making it possible to clarify the let-off. In this structure, the punching 17*b* may be omitted.

It should be understood that the present invention is not limited to the embodiments described above, but can be practiced in a variety of implementations. For example, in the foregoing embodiments, the regulating button contact surfaces 8*a*, 41 are completely flat, but they may be slightly curved to such a degree that a sufficient planar contact can be ensured with the jack contact surface 17*a*. Also, in the foregoing embodiments, the punching 17*b* is attached to the jack contact surface 17*a*, but may alternatively or additionally be attached to the regulating button contact surface 8*a* or 41. Further, in the second embodiment, the prominence 32*b* is formed across the top surface 32*a* of the hammer push-up rod 32 in the left-to-right direction, but may be partially formed. Further alternatively, a plurality of such prominences may be formed.

Also, in the foregoing embodiments, since the jack 7 has a high rigidity, the jack 7 is reduced in weight such that it can promptly return through a pivotal movement associated with a released key to improve the sequentially touching capabilities. Alternatively, since the touch weight of the key 4 is reduced by reducing the jack 7 in weight, the bat spring 3*g* of the hammer 3 may be equivalently enhanced in spring force to increase the speed at which the hammer 3 swings back, in addition to the jack 7, thereby further improving the sequentially touching capabilities. Also, in the foregoing embodiments, the present invention is applied to the action of the upright piano, but the present invention is not so limited, but can be applied to an action of a grand piano. Otherwise, details in structure can be modified as appropriate within the scope of the present invention.

What is claimed is:

1. An action for a piano, configured to actuate in response to a depression on a key to swing a hammer which strikes a string, said action comprising:

a wippen pushed up by said key when said key is depressed to pivotally move upward;

a regulating button having a flat jack contact surface on a lower end, and fixed to a predetermined position above said wippen; and a jack having a regulating button contact protrusion including a flat regulating button contact surface on an upper end, wherein said regulating button contact surface with respect to the contact protrusion is angled such that said regulating button contact surface comes entirely into planar contact with said jack contact surface, and arranged on said wippen for pivotal movement about a jack fulcrum to engage with said hammer such that a pivotal movement of said wippen causes said jack to push up said hammer, and said jack being configured to pivotally move relative to said wippen to come off said hammer by said regulating button contact surface coming into contact with said jack contact surface during the pivotal movement.

2. An action for a piano according to claim 1, further comprising a sheeted damping material on at least one of said jack contact surface or said regulating button contact surface, wherein when said regulating button contact surface comes into contact with said jack contact surface through said damping material, said regulating button contact surface comes into contact with an end of said jack contact surface close to said jack fulcrum, and said regulating button contact surface extends obliquely in close proximity to said jack contact surface.

3. An action for a piano according to claim 1, wherein:

said jack includes a hammer push-up rod extending upward from said jack fulcrum, and configured to engage with said hammer, and said hammer push-up rod includes a prominence formed along an edge of a top surface thereof opposite to said regulating button contact protrusion.

4. An action for a piano according to claim 1, wherein said jack comprises a molding formed of a synthetic resin.

5. An action for a piano according to claim 4, wherein said jack comprises a molding molded by a long-staple method and made of a thermoplastic resin containing long fibers for reinforcement.

6. An action for a piano according to claim 5, wherein said long fibers are carbon fibers.

7. An action for a piano according to claim 5 or 6, wherein said thermoplastic resin is an ABS resin.

* * * * *